US009163842B2

(12) United States Patent
Adams et al.

(10) Patent No.: US 9,163,842 B2
(45) Date of Patent: Oct. 20, 2015

(54) HOME APPLIANCE WITH UNITARY ANTI-TIP BRACKET

(75) Inventors: David Adams, Norris, TN (US); Sibyl Perkins, LaFollette, TN (US); Michael Rutherford, Duff, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 39 days.

(21) Appl. No.: 13/472,525

(22) Filed: May 16, 2012

(65) Prior Publication Data

US 2013/0307397 A1 Nov. 21, 2013

(51) Int. Cl.

| | |
|---|---|
| ***F24C 15/08*** | (2006.01) |
| ***A47B 91/02*** | (2006.01) |
| ***A47B 91/08*** | (2006.01) |

(52) U.S. Cl.

CPC ..... *F24C 15/083* (2013.01); *A47B 91/02* (2013.01); *A47B 91/08* (2013.01)

(58) Field of Classification Search

CPC ..... F24C 15/083
USPC ..... 248/673–677, 154, 500, 300, 301, 501, 248/680, 231.91, 248, 304
See application file for complete search history.

(56) References Cited

U.S. PATENT DOCUMENTS

| | | | | | |
|---|---|---|---|---|---|
| 268,613 | A | * | 12/1882 | Brinkerhoff | 411/485 |
| 476,520 | A | * | 6/1892 | Corscaden | 248/248 |
| 497,015 | A | * | 5/1893 | Conde | 248/680 |
| 585,431 | A | * | 6/1897 | Corscaden | 248/248 |
| 666,918 | A | * | 1/1901 | Butz | 403/190 |
| 670,763 | A | * | 3/1901 | Brodeur | 248/680 |
| 826,626 | A | * | 7/1906 | Throm | 248/680 |
| 973,674 | A | * | 10/1910 | Lilley | 248/248 |
| 976,397 | A | * | 11/1910 | Roberts | 248/680 |
| 989,085 | A | * | 4/1911 | Turton | 248/680 |
| D47,283 | S | * | 5/1915 | Eagan | D8/380 |
| 1,155,376 | A | * | 10/1915 | Sherer | 248/501 |
| 1,313,307 | A | * | 8/1919 | Locraft | 248/680 |
| 1,335,842 | A | * | 4/1920 | Lambert | 248/501 |
| 1,450,183 | A | * | 4/1923 | Moon | 248/680 |
| 1,481,396 | A | * | 1/1924 | Ternes | 248/680 |
| 1,543,253 | A | * | 6/1925 | Gerwig | 248/680 |
| 1,888,265 | A | * | 11/1932 | Guthrie | 411/470 |

(Continued)

FOREIGN PATENT DOCUMENTS

| | | | |
|---|---|---|---|
| DE | 2112465 | A1 * | 9/1972 |
| EP | 1172061 | A1 | 1/2002 |
| EP | 2515045 | A2 * | 10/2012 |

OTHER PUBLICATIONS

Dariusz Rudnicki, Mar. 4, 2009, www.checkthishouse.conn, Home Maintenance, Remolding and Repairs, Kitchen Stove Safety Anti Tip Bracket.

*Primary Examiner* — J. Allen Shriver, II
*Assistant Examiner* — Chiedu Chibogu
(74) *Attorney, Agent, or Firm* — James E. Howard; Andre Pallapies

(57) ABSTRACT

A home appliance, such as a range, for floor-standing operation, including an appliance body, a floor-standing frame supporting the appliance body, the frame including a traverse frame member and an anti-tip bracket mounted to a support surface, the anti-tip bracket including a stanchion and an engagement member projecting from the stanchion in an generally horizontal manner and a tooth projecting downwardly from a distal end of the engagement member for engagement with a portion of the traverse frame member.

20 Claims, 4 Drawing Sheets

(56) References Cited

U.S. PATENT DOCUMENTS

| | | | | | |
|---|---|---|---|---|---|
| D127,587 | S | * | 6/1941 | MacArthur | D8/381 |
| 2,649,831 | A | * | 8/1953 | Anstett | 411/80.1 |
| 2,651,483 | A | * | 9/1953 | Ritchie et al. | 248/680 |
| 2,709,494 | A | * | 5/1955 | Luce | 180/68.5 |
| 2,747,821 | A | * | 5/1956 | Falk | 248/71 |
| 2,913,204 | A | * | 11/1959 | Stewart | 248/71 |
| 3,156,443 | A | * | 11/1964 | Lupinacci | 248/211 |
| 3,280,829 | A | * | 10/1966 | Glendenning et al. | 135/118 |
| 3,730,472 | A | * | 5/1973 | Dale | 248/300 |
| 3,984,077 | A | * | 10/1976 | Shine | 248/248 |
| 3,994,462 | A | * | 11/1976 | Shine | 248/248 |
| 4,377,254 | A | * | 3/1983 | Huffman et al. | 494/12 |
| 4,526,020 | A | * | 7/1985 | Fey et al. | 68/3 R |
| 4,535,610 | A | * | 8/1985 | Fey et al. | 68/3 R |
| 4,669,695 | A | | 6/1987 | Chou | |
| 4,754,948 | A | | 7/1988 | Casciani | |
| 4,787,577 | A | * | 11/1988 | Whittle | 244/129.4 |
| 4,890,813 | A | * | 1/1990 | Johnson et al. | 248/680 |
| 5,031,864 | A | * | 7/1991 | Krol | 248/71 |
| 5,054,579 | A | * | 10/1991 | Moson | 182/107 |
| 5,076,525 | A | | 12/1991 | Whipple | |
| 5,083,738 | A | * | 1/1992 | Infanti | 248/500 |
| 5,131,617 | A | * | 7/1992 | McGarrah | 248/500 |
| 5,174,543 | A | | 12/1992 | Corson et al. | |
| 5,184,792 | A | * | 2/1993 | Bernhard et al. | 248/71 |
| 5,192,123 | A | * | 3/1993 | Wallin | 312/351.7 |
| 5,263,676 | A | * | 11/1993 | Medlin et al. | 248/300 |
| D342,889 | S | * | 1/1994 | Adams | D8/367 |
| 5,395,080 | A | * | 3/1995 | Smith | 248/215 |
| 5,404,895 | A | * | 4/1995 | Yamauchi et al. | 134/201 |
| 5,499,691 | A | * | 3/1996 | Fitzpatrick | 182/107 |
| 5,624,098 | A | * | 4/1997 | McDowell | 248/550 |
| 5,690,311 | A | * | 11/1997 | Leighton et al. | 248/681 |
| 5,799,921 | A | * | 9/1998 | Stattel | 248/501 |
| 5,836,131 | A | * | 11/1998 | Viola et al. | 52/702 |
| 5,885,024 | A | * | 3/1999 | Zupan et al. | 403/389 |
| 5,916,353 | A | * | 6/1999 | Bennett et al. | 99/474 |
| 5,954,307 | A | * | 9/1999 | Williams | 248/501 |
| 5,961,081 | A | * | 10/1999 | Rinderer | 248/68.1 |
| D436,310 | S | * | 1/2001 | Arnold | D8/354 |
| 6,227,507 | B1 | * | 5/2001 | Kallio | 248/250 |
| 6,345,874 | B2 | * | 2/2002 | Duong et al. | 312/351.1 |
| 6,412,745 | B1 | * | 7/2002 | Yokoyama et al. | 248/500 |
| 6,533,238 | B2 | * | 3/2003 | Barnes et al. | 248/680 |
| D481,621 | S | * | 11/2003 | Whipple et al. | D8/388 |
| D481,622 | S | * | 11/2003 | Whipple et al. | D8/388 |
| 6,758,016 | B2 | * | 7/2004 | Gobeil | 52/191 |
| D497,101 | S | * | 10/2004 | Whipple et al. | D8/388 |
| D503,330 | S | * | 3/2005 | Murphy et al. | D8/354 |
| 7,185,874 | B2 | * | 3/2007 | Deiss et al. | 248/680 |
| 7,240,889 | B2 | * | 7/2007 | Giovinazzi | 248/501 |
| 7,258,249 | B1 | * | 8/2007 | Frederick et al. | 221/282 |
| D621,241 | S | * | 8/2010 | Mirer et al. | D8/367 |
| 7,788,873 | B2 | * | 9/2010 | Leek | 52/702 |
| 8,061,676 | B1 | * | 11/2011 | Kumar | 248/501 |
| 8,220,770 | B2 | * | 7/2012 | Justis | 248/677 |
| D674,680 | S | * | 1/2013 | Mirer et al. | D8/367 |
| 8,727,300 | B2 | * | 5/2014 | Maier et al. | 248/674 |
| 2005/0051697 | A1 | * | 3/2005 | Lowenstein, Jr. | 248/680 |
| 2007/0164190 | A1 | * | 7/2007 | Lowenstein, Jr. | 248/680 |
| 2010/0282939 | A1 | * | 11/2010 | Rinderer | 248/231.91 |
| 2010/0282940 | A1 | * | 11/2010 | Jerg et al. | 248/680 |
| 2011/0050064 | A1 | * | 3/2011 | Phillips et al. | 312/351.3 |
| 2011/0089304 | A1 | * | 4/2011 | Fenelon | 248/404 |

* cited by examiner

HOME APPLIANCE WITH UNITARY ANTI-TIP BRACKET

BACKGROUND OF THE INVENTION

The present invention is related broadly to home appliances that may be susceptible to tipping and, more particularly, to a home appliance, such as a range, having a unitary anti-tip bracket.

Home appliances, such as ranges used for cooking are typically relatively large, floor-standing, box-like structures that generally stay firmly in place under their own weight. Nevertheless, if the overall structure is altered, tipping may become a danger. Most ranges include an oven and provide an access opening to the oven. A door is used to cover the access opening and is movable between a closed position wherein the door is against the range body and has no influence in tipping the range, and an open position wherein the door projects away from the range body in a generally horizontal manner. If sufficient downward force is applied to the door, the door can act as a lever that could cause the range to rotate or pivot on its front feet to lift the rear portion off the floor, thereby tipping the range.

In the past, multi-piece anti-tip devices have been mounted near the base in the rear of a range. Generally, one part on the range is fastened to another part attached to a support structure. Such devices can be difficult to successfully manipulate into operation during installation of a range which often involves fitting the range between adjacent cabinet structures which are not readily movable. Further, the relatively precise placement required of both the anti-tip device or bracket and the range can make installation even more difficult. In addition, once the anti-tip device is attached to the range, further height adjustment of the range is usually precluded.

There currently exists a need for a single piece or unitary anti-tip device that makes installation a more straightforward matter and can reduce the cost of current devices.

SUMMARY OF THE INVENTION

It is accordingly an intent of the present invention to provide a home appliance, particularly a range, with a unitary anti-tip bracket that it is mounted to a support in a straightforward manner and includes a large horizontal target area for engagement of the bracket with a tipping appliance. The present invention is also intended to provide such an anti-tip bracket that accommodates a home appliance at various heights within the adjustability range provided by the home appliance.

It is another intention of the present invention to provide a home appliance with an anti-tip bracket that can be attached to multiple support surfaces at multiple locations along each of the support surfaces.

It is also the intent of the present invention to provide such an anti-tip bracket that prevents the home appliance from moving out from under the anti-tip bracket while the appliance is attempting to tip over.

To those ends, the present invention is directed to a home appliance for floor-standing operation, including an appliance body and a floor-standing frame supporting the appliance body. The frame includes a traverse frame member. An anti-tip bracket is included and mounted to a support surface. The anti-tip bracket includes including a stanchion and an engagement member projecting from the stanchion in a generally horizontal manner. A tooth projects downwardly from a distal end of the engagement member for engagement with a portion of the traverse frame member.

Preferably, the stanchion is mounted to the support surface and extends upwardly from a base with the engagement member projecting outwardly from an uppermost portion of the stanchion. It is further preferred that the stanchion includes a plurality of openings arranged vertically therealong for mounting the stanchion to a vertically extending support surface.

It is preferred that the present invention further includes a stanchion and a base mounted to the stanchion with the stanchion projecting upwardly from the base, the base being mounted to the support surface.

Preferably, the engagement member and the stanchion define a space between the engagement member and the base to accommodate vertical adjustment of the home appliance.

It is further preferred that the stanchion includes a plurality of openings arranged vertically therealong for selective mounting the stanchion to a vertically extending support surface and the base preferably includes a plurality of openings arranged horizontally therealong for selective mounting the stanchion to a horizontally extending support surface.

It is preferred that the traversely extending frame member extends generally through a majority of the width of the home appliance and the anti-tip bracket is configured to engage the traverse frame member substantially anywhere along the lateral extent of the traverse frame member.

Preferably, the anti-tip bracket is formed as a hook for engagement with the traverse frame member when the home appliance is tipped.

It is preferential that the stanchion includes a curved edge portion extending vertically therealong to resist cutting electrical lines and gas lines.

It is further preferred that the anti-tip bracket is formed from a unitary metal sheet.

The present invention is also directed to a floor-standing range for cooking. To that end, the present invention is directed to a range including a range body and a floor-standing frame supporting the body, the frame including a traverse frame member. Also included is an anti-tip bracket mounted to a support surface. The anti-tip bracket includes a stanchion and an engagement member projecting from the stanchion in an generally horizontal manner, and at least one tooth projecting downwardly from a distal end of the engagement member for engagement with a portion of the traverse frame member.

It is preferred that the stanchion is mounted to the support surface and extends upwardly from a base with the engagement member projecting outwardly from an uppermost portion of the stanchion. Preferably, the stanchion includes a plurality of openings arranged vertically therealong for mounting the stanchion to a vertically extending support surface.

Preferably, the present invention further includes a stanchion and a base mounted to the stanchion with the stanchion projecting upwardly from the base, the base being mounted to the support surface. It is further preferred that the engagement member and the stanchion define a space between the engagement member and the base to accommodate vertical adjustment of the range.

It is preferred that the stanchion includes a plurality of openings arranged vertically therealong for selective mounting the stanchion to a vertically extending support surface and the base preferably includes a plurality of openings arranged horizontally therealong for selective mounting the stanchion to a horizontally extending support surface.

It is preferential that the traversely extending frame member extends generally the majority of the width of the range and the anti-tip bracket is configured to engage the traverse frame member substantially anywhere along the extent of the traverse frame member.

Preferably, the anti-tip bracket is formed as a hook for engagement with the traverse frame member when the range is tipped.

Preferentially, the stanchion includes a curved edge portion extending vertically therealong to resist cutting electrical lines and gas lines.

Preferably, the anti-tip bracket is formed from a unitary metal sheet.

By the above, the present invention provides a home appliance, particularly a range, with an anti-tip bracket that offers substantial cost savings over past brackets. The present invention also provides a large target area for the bracket if the range tips, thereby providing substantially enhanced tolerance for the position of the bracket with respect to the range. Further, the present anti-tip bracket prevents the range from sliding out from under the bracket as the range is attempting to tip forward. For secure mounting, the present bracket allows attachment to two different surfaces including a back wall and a floor, with the option of multiple fastening points along each surface. Finally, the sheet metal used to form the bracket is curved in a manner to prevent the potential laceration of incoming gas, electrical or other type of supply lines during installation or repair of the range.

DESCRIPTION OF THE PREFERRED EMBODIMENT

Figure 1:
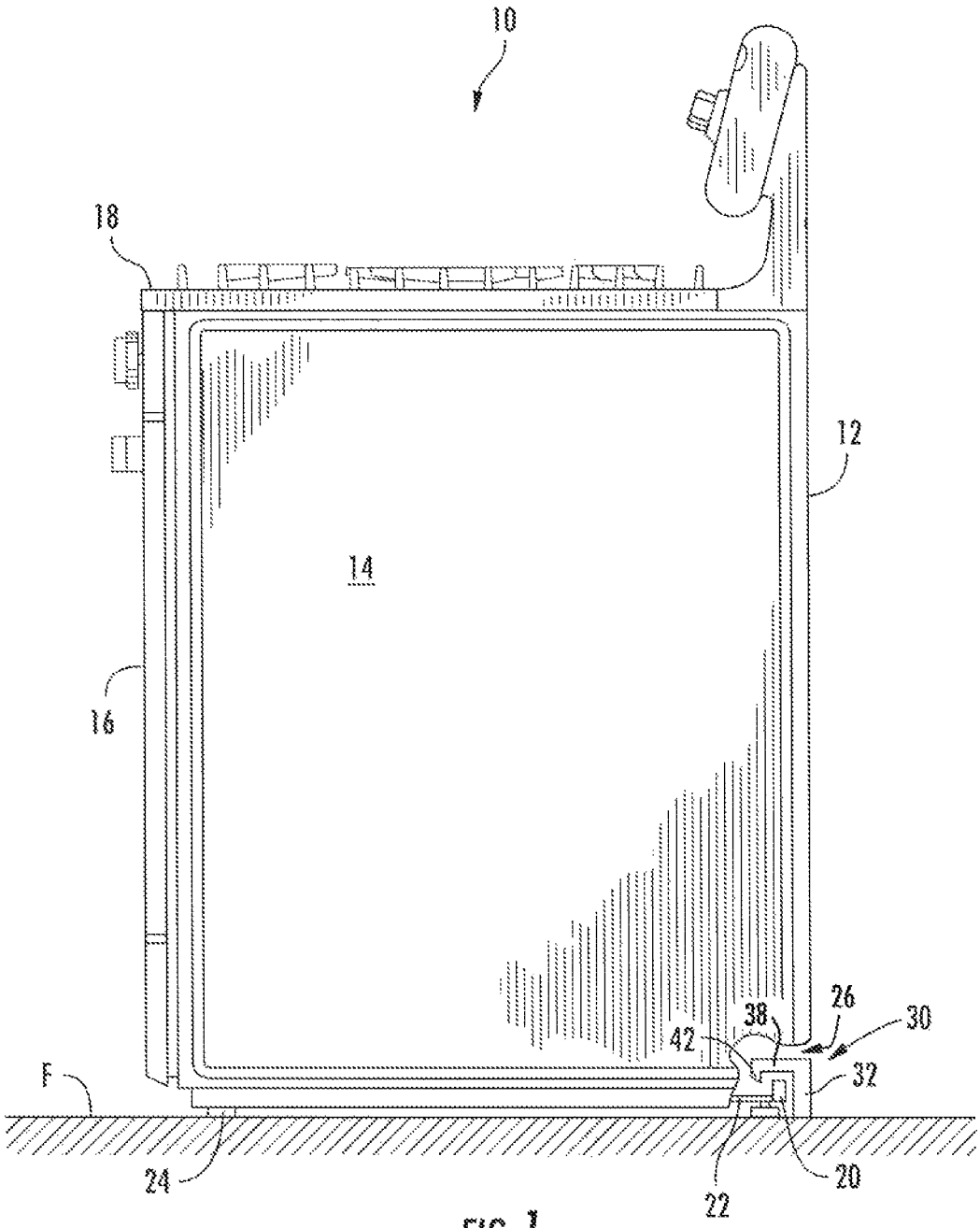
FIG. 1 is a side view of a home appliance in the form of a range broken open to show the anti-tip bracket according to the preferred embodiment of the present invention.
Figure 4:
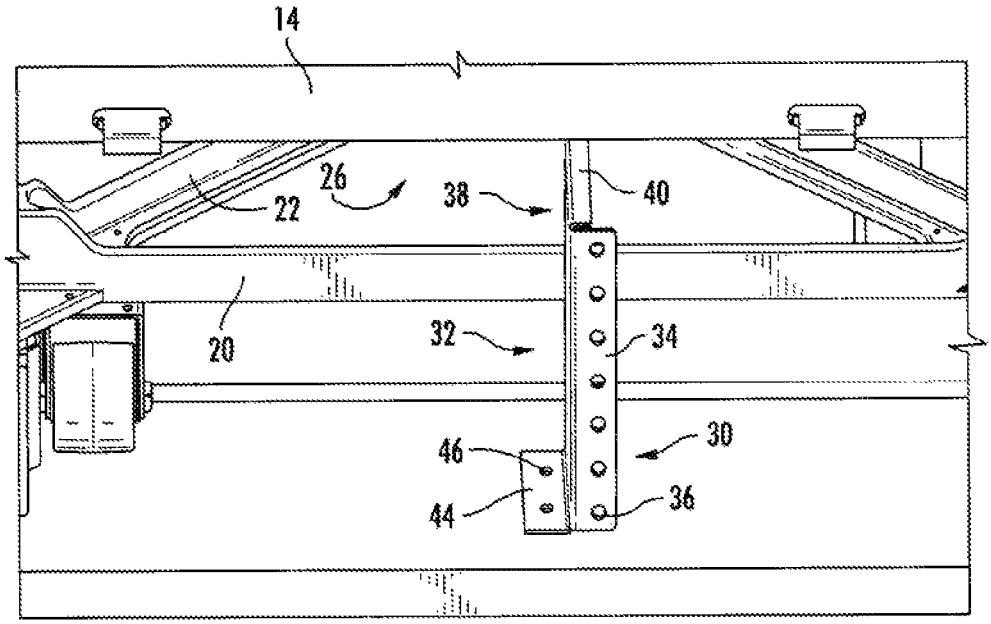
FIG. 4 is a rear view of the anti-tip bracket illustrated in FIG. 2.

Turning now to the drawings and, more particularly to FIG. 1, an appliance in the form of a range is illustrated at 10 and includes a floor-standing, box-like range body 12 that includes a generally skeletal frame covered by several generally planar body panels 14. A cooktop 18 is on top of the range body 12 and the interior of the range body 12 defines an oven (not shown) covered by a door 16 in the front portion of the range. The range 10 is supported on a floor F by feet 24 located at the corners of the range body 12. A frame structure 22 within the body panels 14 includes a frame member 20 that extends traversely across the back of the range 12 adjacent to a supporting floor F. As seen in FIG. 1 and FIG. 4, the body panel 14 in the rear of the range does not cover the traverse frame member, thereby defining an access opening 26 for access by the anti-tip bracket 30. The access opening 26 extends from a region adjacent one rear corner of the range body to a region adjacent an opposing rear corner of the range body. The traverse frame member 20 is positioned for use with the anti-tip bracket 30 of the present invention.

Figure 3:
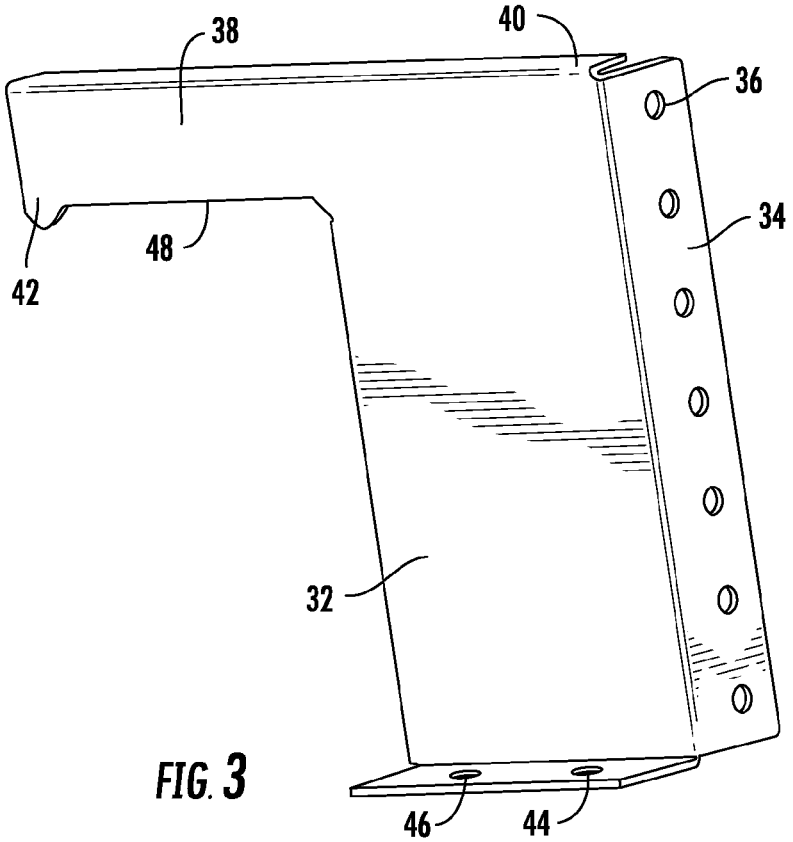
FIG. 3 is a side perspective view of the anti-tip bracket illustrated in FIG. 2.
Figure 5:
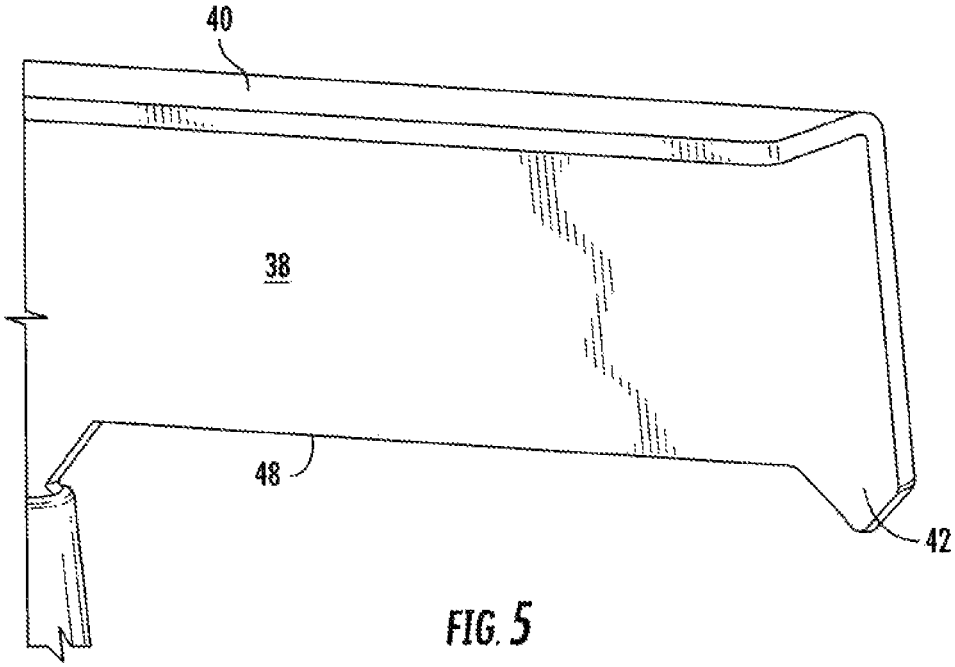
FIG. 5 is a side view of the engagement member of the anti-tip bracket illustrated in FIG. 2.

An anti-tip bracket 30 is mounted to the floor F and is formed as an inverted L-shaped structure with an upstanding stanchion 32 and, with reference to FIGS. 3 and 5, a generally rectangular engagement member 38 projecting away from the stanchion 32 and in a cantilever manner. A tooth 42 projects downwardly from the distal end of the engagement member 38 which acts to prevent the range from sliding out from under the anti-tip bracket 30 when the range 10 is in the act of tipping.

Figure 2:
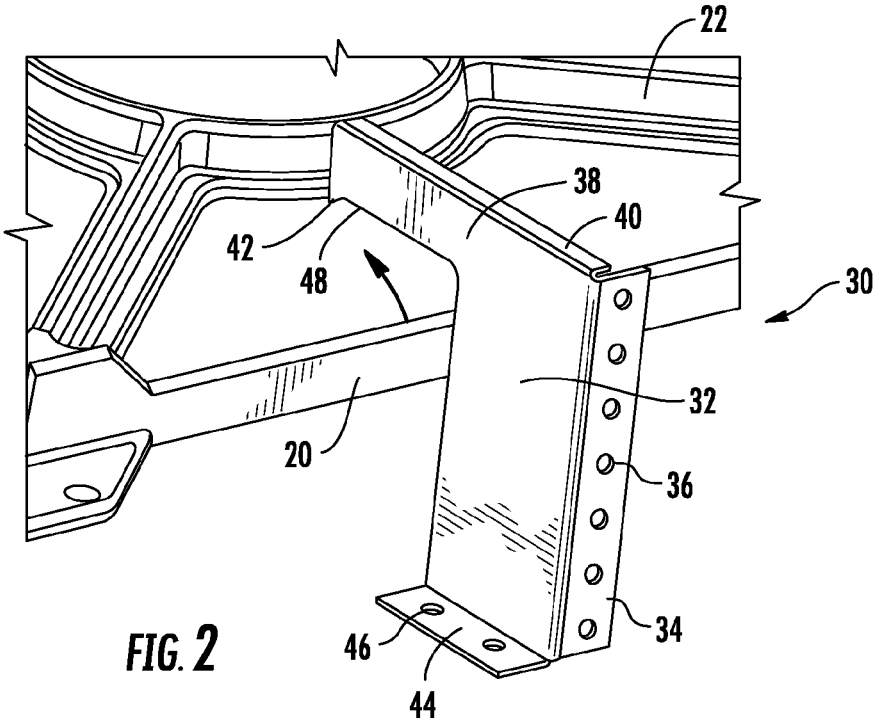
FIG. 2 is a perspective view of the anti-tip bracket illustrated in FIG. 1 with respect to a range frame.

The relationship between the anti-tip bracket 30 and the traverse frame member 20 is illustrated in greater detail in FIG. 2, while the anti-tip bracket 30 itself is illustrated in FIG. 3. As seen in FIGS. 2 and 3, the anti-tip bracket 30 is formed from a single sheet of material, preferably metal and includes the stanchion 32 with engagement member 38 projecting away from the stanchion 32 and terminating in a distal end portion having the tooth 42 projecting downwardly therefrom. The underside of the engagement member 36 extending from the tooth 42 to the stanchion 32 defines an engagement surface 48 for contact with the traverse frame member 20 of a tipping range.

With reference to FIGS. 2, 3, 4 and 6, the anti-tip bracket 30 may be mounted on a number of support structures. In that regard, a rear portion of the stanchion 31 extends generally perpendicularly away from the main body of the stanchion 32 to define a rear wall 34. The rear wall 34 extends the length of the stanchion and includes a number of openings 36 for attachment to a vertical support structure using fasteners such as screws or other fasteners.

The present anti-tip bracket 30 may also be mounted to a horizontal support surface. To that end, a base 44 is folded to extend from the stanchion 32 to extend perpendicularly away from the stanchion 32 in a direction opposite that of the stanchion back wall 34. A number of openings 46 are defined in the base 44 for use in mounting the anti-tip bracket 30 to a horizontal support structure, such a floor, using screws or other fasteners. As may be expected, the anti-tip bracket 30 may also be simultaneously mounted to both a vertical support surface with a horizontal support surface.

Figure 6:
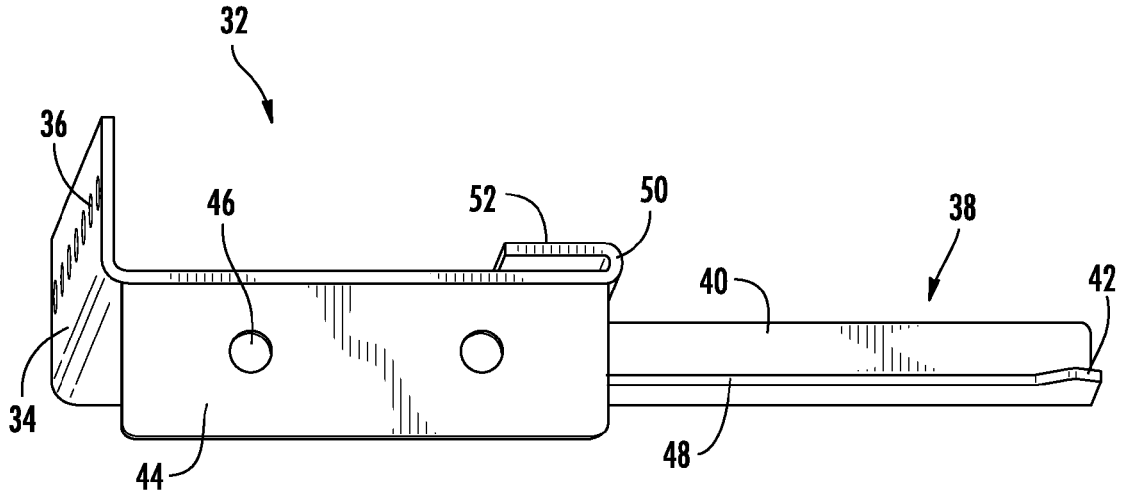
FIG. 6 is a bottom view of the anti-tip bracket illustrated in FIG. 2.

In order to enhance the overall structural strength of the engagement member 38, and as seen in FIGS. 4, 5 and 6, a small flap 40 is folded away from the engagement member 38 in a direction opposite from the direction of the base 44 extension, and extends the length of the engagement member 38.

As seen in FIGS. 2 and 3, the area defined between the base 44 and the engagement member 38 provides a relatively large space to accommodate vertical adjustment of the range height without affecting the anti-tip properties of the present device. Further, the downwardly projecting tooth 42, as seen in FIGS. 3 and 5, prevents the range from sliding out from under the anti-tip bracket during a tipping event.

One feature of the present invention is the ability to engage the traverse frame member 20 along a substantial extent of the traverse frame member 20, thereby making the mounting position of the anti-tip bracket 30 far less critical than past brackets which required a part of the range to be attached to a specific portion of an anti-tip bracket which therefore required precision mounting of the range and the anti-tip bracket. As seen in FIGS. 2 and 4, since the bracket 30 is not mounted to the traverse frame member 20, the present anti-tip bracket 30 can engage and operate with the traverse frame member 20 along a wide range of laterally-extending positions.

Since the anti-tip bracket is preferably formed from metal, it would be possible to encounter sharp edges on the bracket 30 at various positions, particularly along the stanchion 32 under the engagement member 38. Such metal edges could become hazardous for wiring, and gas piping, especially during installation or removal of a range. With reference to FIG. 6, the present invention provides a curved portion 50 formed from a portion of the stanchion 32 that turns a flap 52 180° to extend along the stanchion 32 for a short distance to remove any sharp edges from substantially anywhere that would likely encounter electrical wiring or gas piping and presents a smoothly-curved surface facing the rear portion of the range 10.

With reference to FIG. 1, a typical cause of tipping is a weight or some other force applied to the oven door 16 while it is open. If the range starts to tip, the range body 12 will pivot on its front feet 24 thereby raising the rear portion off the support surface or floor F driving the frame 22 and associated traverse frame member 20 into rotation about an axis defined at the front feet 24. The engagement member 38 provides an abutment surface 48 for the traversely-extending frame member 20 to prevent tipping of the range beyond a few degrees of angular displacement.

By the above, the present invention provides a one-piece anti-tip bracket that is more straightforward to manufacture than those in the past. In addition, the large target area provided by the present invention enhances the ability to effectively and efficiently install a range. Further, the structure of the inverted L-shaped anti-tip bracket accommodates various adjustments of the range height. The curved structure of the anti-tip bracket provides protection against lacerating wires and gas lines. Further, the anti-tip bracket may be mounted on a vertical surface, a horizontal surface or both. The present anti-tip bracket is a one-piece unit, thereby providing a cost savings.

It will therefore be readily understood by those persons skilled in the art that the present invention is susceptible of a broad utility and application. While the present invention is described in all currently foreseeable embodiments, there may be other, unforeseeable embodiments and adaptations of the present invention, as well as variations, modifications and equivalent arrangements, that do not depart from the substance or scope of the present invention. The foregoing disclosure is not intended or to be construed to limit the present invention or otherwise to exclude such other embodiments, adaptations, variations, modifications and equivalent arrangements, the present invention being limited only by the claims appended hereto and the equivalents thereof.

What is claimed is:

1. A home appliance for floor-standing operation, the home appliance comprising:

an appliance body having a base portion with at least two front corners, at least two rear corners and at least one rear body panel defining an access opening, the access opening extending laterally from a region adjacent one rear corner of the appliance body to a region adjacent an opposing rear corner of the appliance body;

a floor-standing frame supporting the appliance body, the frame including a plurality of support feet with a support foot adjacent each of four corners of the appliance body; and a traverse frame member accessible through the access opening; and an anti-tip bracket for mounting to a support surface for arresting ongoing tipping movement of the appliance body, the anti-tip bracket being formed from a single material sheet and including a stanchion, an engagement member projecting laterally away from the stanchion, the engagement member including an engagement surface, and a tooth projecting downwardly from a distal end of the engagement member, with the engagement surface extending between the stanchion and the tooth for engagement with a portion of the traverse frame member during tipping movement of the appliance body, the anti-tip bracket further including a rear wall extending laterally away from the stanchion in a first direction, a base extending laterally away from the stanchion in a second direction, the second direction being different from the first direction, and a flap extending laterally away from the engagement member, wherein the engagement member can be engaged by the traverse frame member anywhere along the engagement surface and throughout the extent of the access opening during the tipping movement of the appliance body.

2. The home appliance of claim 1 wherein the stanchion extends upwardly from the base with the engagement member projecting outwardly from an uppermost portion of the stanchion.

3. The home appliance of claim 2 wherein the rear wall includes more than two openings arranged vertically therealong for mounting the stanchion to a vertically extending portion of the support surface at a selected one of multiple locations.

4. The home appliance of claim 1 wherein the base includes a plurality of openings arranged horizontally therealong for mounting the base to a horizontally extending portion of the support surface.

5. The home appliance of claim 1 wherein the engagement member is spaced from the base to accommodate vertical adjustment of the home appliance body.

6. The home appliance of claim 1 wherein the rear wall includes more than two openings arranged vertically therealong for selectively mounting the stanchion to a vertically extending portion of the support surface at a selected one of multiple locations and wherein the base includes a plurality of openings for selectively mounting the stanchion to a horizontally extending portion of the support surface.

7. The home appliance of claim 1 wherein the anti-tip bracket is formed as a hook for engagement with the traverse frame member when the home appliance body is tipped.

8. The home appliance of claim 1 wherein the stanchion includes a curved edge portion extending vertically therealong to resist cutting electrical lines and gas lines.

9. The home appliance of claim 1 wherein the anti-tip bracket is formed from a single metal sheet.

10. A range for floor-standing operation, the range comprising: a range body having a base portion with at least two front corners, at least two rear corners and at least one rear body panel defining an access opening, the access opening extending laterally from a region adjacent one rear corner of the range body to a region adjacent an opposing rear corner of the range body;

a floor-standing frame supporting the range body, the frame including a plurality of support feet with a support foot adjacent each of four corners of the range body; and a traverse frame member accessible through the access opening; and an anti-tip bracket for mounting to a support surface for arresting ongoing tipping movement of the range body, the anti-tip bracket being formed from a single material sheet and including a stanchion, an engagement member projecting laterally away from the stanchion, the engagement member including an engagement surface, and a tooth projecting downwardly from a distal end of the engagement member, with the engagement surface extending between the stanchion and the tooth for engagement with a portion of the traverse frame member during tipping movement of the range body, the anti-tip bracket further including a rear wall extending laterally away from the stanchion in a first direction, a base extending laterally away from the stanchion in a second direction, the second direction being different from the first direction, and a flap extending laterally away from the engagement member, wherein the engagement member can be engaged by the traverse frame member anywhere along the engagement surface and throughout the extent of the access opening during the tipping movement of the range body.

11. The range of claim 10 wherein the stanchion extends upwardly from the base with the engagement member projecting outwardly from an uppermost portion of the stanchion.

12. The range of claim 11 wherein the rear wall includes more than two openings arranged vertically therealong for mounting the stanchion to a vertically extending portion of the support surface at a selected one of multiple locations.

13. The range of claim 10 wherein the base includes a plurality of openings arranged horizontally therealong for mounting the base to a horizontally extending portion of the support surface.

14. The range of claim 10 wherein the engagement member is spaced from the base to accommodate vertical adjustment of the range body.

15. The range of claim 10 wherein the stanchion includes more than two openings arranged vertically therealong for selectively mounting the stanchion to a vertically extending portion of the support surface at a selected one of multiple locations and wherein the base includes a plurality of openings for selectively mounting the stanchion to a horizontally extending portion of the support surface.

16. The range of claim 10 wherein the anti-tip bracket is formed as a hook for engagement with the traverse frame member when the range body is tipped.

17. The range of claim 10 wherein the stanchion includes a curved edge portion extending vertically therealong to resist cutting electrical lines and gas lines.

18. The range of claim 10 wherein the anti-tip bracket is formed from a single metal sheet.

19. A home appliance for floor-standing operation, the home appliance comprising:

an appliance body having a base portion with at least two front corners, at least two rear corners and at least one rear body panel defining an access opening, the access opening extending laterally from a region adjacent one rear corner of the appliance body to a region adjacent an opposing rear corner of the appliance body;

a floor-standing frame supporting the appliance body, the frame including a plurality of support feet with a support foot adjacent each of four corners of the appliance body; and a traverse frame member accessible through the access opening; and an anti-tip bracket configured for being mounted to at least one of a horizontally extending and a vertically extending support surface for arresting ongoing tipping movement of the appliance body, the anti-tip bracket including:

a stanchion;

an engagement member projecting laterally away from the stanchion, the engagement member including an engagement surface extending into the access opening without contacting the traverse frame member until the traverse frame member is raised during tipping movement of the appliance body; and the anti-tip bracket further including a tapered tooth projecting downwardly from a distal end of the engagement member for engagement with a portion of the traverse frame member during tipping movement of the appliance body, wherein the anti-tip bracket is mountable via a transversely flanged rear wall portion of the stanchion to the at least one of the horizontally extending and the vertically extending support surface at multiple locations on the at least one of the horizontally extending and the vertically extending support surface opposing the access opening for engagement with the traverse frame member during the tipping movement of the appliance body, wherein the engagement member can be engaged by the traverse frame member anywhere along the engagement surface and throughout the extent of the access opening, wherein the rear wall portion projects laterally away from the stanchion and has more than two openings arranged vertically therealong for mounting the stanchion to the at least one of the horizontally extending and the vertically extending support surface at the selected one of multiple locations, the anti-tip bracket is formed from a single material sheet, the stanchion includes a curved front edge portion extending vertically therealong to resist cutting electrical lines and gas lines, the curved front edge portion and the transversely flanged rear wall portion are parallel relative to one another and are located on distally opposed sides portions of a planar portion of the stanchion, and wherein the tapered tooth and the engagement member are planar and are disposed in the same imaginary plane.

20. A home appliance for floor-standing operation, the home appliance comprising:

an appliance body having a base portion with at least two front corners, at least two rear corners and at least one rear body panel defining an access opening, the access opening extending laterally from a region adjacent one rear corner of the appliance body to a region adjacent an opposing rear corner of the appliance body;

a floor-standing frame supporting the appliance body, the frame including a plurality of support feet with a support foot adjacent each of four corners of the appliance body; and a traverse frame member accessible through the access opening; and an anti-tip bracket for mounting to a support surface for arresting ongoing tipping movement of the appliance body, the anti-tip bracket being formed from a single material sheet and including:

a stanchion;

an engagement member projecting laterally away from the stanchion, the engagement member including an engagement surface and a tooth projecting downwardly from a distal end of the engagement member, with the engagement surface extending between the stanchion and the tooth, the engagement member extending into the access opening without contacting the traverse frame member until a rear surface is raised during the tipping movement of the appliance body;

the anti-tip bracket further including a rear wall extending laterally away from the stanchion in a first direction, a base extending laterally away from the stanchion in a second direction, the second direction being different from the first direction, and a flap extending laterally away from the engagement member, wherein the engagement member can be engaged by the traverse frame member anywhere along the engagement surface and throughout the extent of the access opening during the tipping movement of the appliance body; and a planar tapered tooth projecting downwardly from a distal end of the engagement member for engagement with a portion of the traverse frame member during tipping movement of the appliance body, wherein the anti-tip bracket is mountable to the support surface at multiple locations on the support surface for engagement with the traverse frame member through the access opening during the tipping movement of the appliance body.

* * * * *